United States Patent [19]

Fischer et al.

[11] 4,306,609

[45] Dec. 22, 1981

[54] METHOD AND APPARATUS FOR PACKING GRANULAR MATERIALS

[75] Inventors: Kurt Fischer, Schaffhausen; Robert Steinemann, Utzigen; Hans Tanner, Schaffhausen, all of Switzerland

[73] Assignee: Georg Fischer Aktiengesellschaft, Schaffhausen, Switzerland

[21] Appl. No.: 102,539

[22] Filed: Dec. 11, 1979

[30] Foreign Application Priority Data

Dec. 15, 1978 [CH] Switzerland ..... 12768/78
Nov. 14, 1979 [CH] Switzerland ..... 10150/79

[51] Int. Cl.[3] ..... B22C 15/00
[52] U.S. Cl. ..... 164/37; 164/169
[58] Field of Search ..... 164/15, 37–40, 164/169–171, 207, 212; 264/84; 425/1; 100/DIG. 11; 29/56, 421 E; 72/DIG. 25

[56] References Cited

U.S. PATENT DOCUMENTS 3,170,202 2/1965 Huston, Sr. et al. ..... 164/37

*Primary Examiner*—Robert D. Baldwin
*Assistant Examiner*—K. Y. Lin
*Attorney, Agent, or Firm*—Toren, McGeady and Stanger

[57] ABSTRACT

For packing granular materials, especially foundry moulding materials, by means of an exothermic reaction of a mixture of air and fuel in a combustion chamber (23), a relative movement between the combustible mixture and one or several pulse triggers (19), is produced during the exothermic reaction, preferably by a blower (20) disposed in the combustion chamber (23). Hence the measured amount of sand introduced into a moulding frame (11) and a filling frame (12) over a pattern (6) by means of a sand container (17) is packed to form a mould body.

14 Claims, 5 Drawing Figures

METHOD AND APPARATUS FOR PACKING GRANULAR MATERIALS

Figure 1:
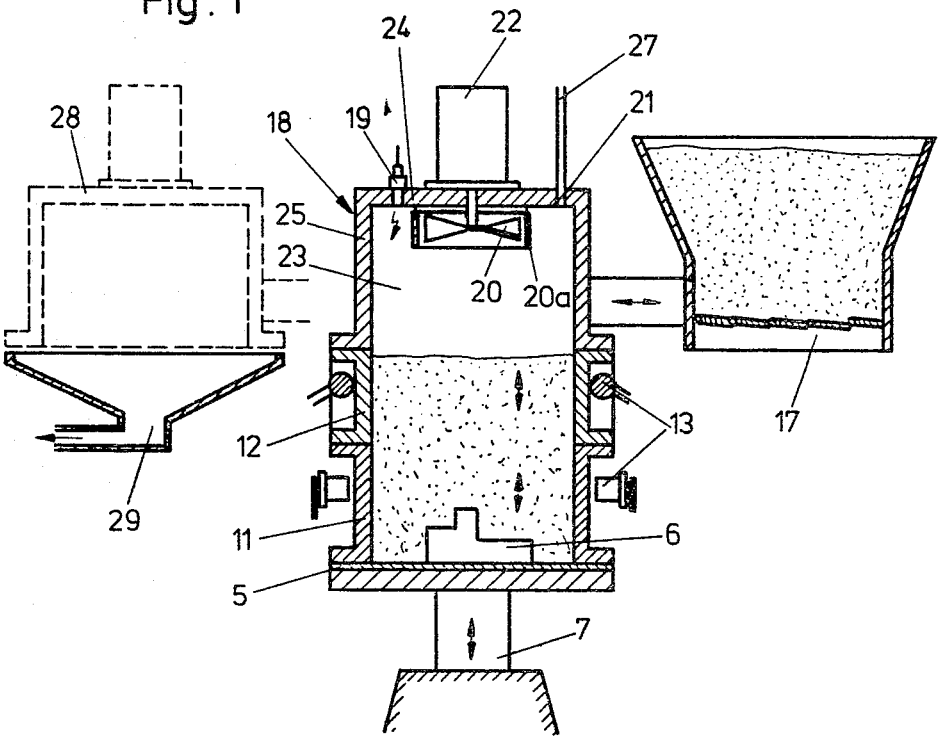

The present invention relates to a process for packing or compressing granular materials, especially foundry moulding material, by means of an exothermic reaction of a mixture of air and fuel in a closed system, a device for carrying out the process according to the preamble of claim 14 and the use of the process for controlling the packing or the compressive strength of granular materials, preferably foundry moulding materials.

The explosion packing process proposed hitherto in the foundry industry for the production of moulds and cores (U.S. Pat. No. 3,170,202) did not come out of the experimental stage.

In particular the following factors proved to be disadvantageous:

Safety risk in the storage and handling of explosive materials in the foundry area;

Lacking reproducibility of the achieved results;

The necessary combustion pressures could only be achieved by pre-compressing the combustible mixture in the combustion chamber, which means an additional expense and sealing problems;

Without the use of additional oxygen the strength values necessary for foundry purposes were not achieved;

The use of additional oxygen made the process unduly expensive and increased the safety risk.

It is an object of the present invention to propose a process which does not have the disadvantages mentioned and allows the economical and safe production of moulds with a predetermined, high reproducible compressive strength value, without the use of additional oxygen and without previous essential precompression.

This aim is achieved by the teaching given in the claims. Further features and special embodiments of this teaching are also given in the claims.

By these features a desired reproducible combustion process is achieved. At the same time an increase in the intensity of the exothermic reaction can also be achieved.

Of particular importance is the increase in the propagation speed of the combustion process through the forced movement of the combustible mixture. Only after this step is it possible, without the use of additional oxygen, to increase the propagation speed so that the necessary strength values are achieved.

The combustible mixture is preferably brought into a selfcontained, closed loop current, variable in its speed, by a power-variable blower, which is either in the combustion chamber itself or is connected to the combustion chamber. However, another production of movement is also possible e.g. with mixing valves or the like. A desired combustion process can also be achieved by the actuation of the initial pulse triggers.

The power variability of the blower makes it possible, via the variable current of the combustible mixture, to achieve a desired mould strength, each according to the particular circumstances. The correlation between movement intensity and mould strength is hence a positive one. Typical speeds for the combustible mixture lie in the range of 20–50 $ms^{-1}$.

The fuel is preferably introduced into the air in the combustion chamber which is at ambient pressure. When using a stoichiometric amount e.g. of natural gas, the pressure in the combustion chamber thus increases by about 0.1 bar. With a slight excess pressure of this kind there are no substantial sealing problems and hence no gas losses nor safety problems.

The stoichiometric ratio between air and fuel does not, however, have to be adhered to; it is only essential that the resultant mixture remains combustible.

One can consider as fuels both solid materials as well as liquid and gaseous materials. The following have proved to be particularly suitable: natural gas, methane, propane, butane, acetylene, gasoline, diesel oil. Also pyrophoric dusts, like coal dust, saw dust etc., can be suitable.

A further advantage of the process of the invention is the fact that the maximum pressure in the closed system, reached after initiation of the combustion, is under 8 bar, which considerably simplifies the construction of the packing device and considerably lowers the stress on the device.

With all explosion packing processes the rear of the packed mould becomes brittle and friable and the combustion heat dries out a 5–10 mm thick sand layer. One embodiment of the process of the invention allows the elimination of this disadvantage. It consists in that the surface of the granular material to be packed is provided, before initiation of the explosion, with a gas-impermeable cover. If the cover is fitted only partially, by means of a container open at the bottom, the side walls of which dip into the sand, then at the same time compressive strength on the top of the mould, can be controlled locally.

A further possibility of controlling the mould strength on the upper surface of the mould, apart from the already mentioned power variability of the blower, lies in the changing of the volume of the combustion chamber, again with positive correlation.

The process of the invention is not only used in the foundry industry for the production of casting moulds and cores but can also be used in the building industry for packing building materials.

The invention will now be described in more detail by means of the embodiments shown in the drawing and relating to moulding sand packing but not limited to this.

Figure 2:
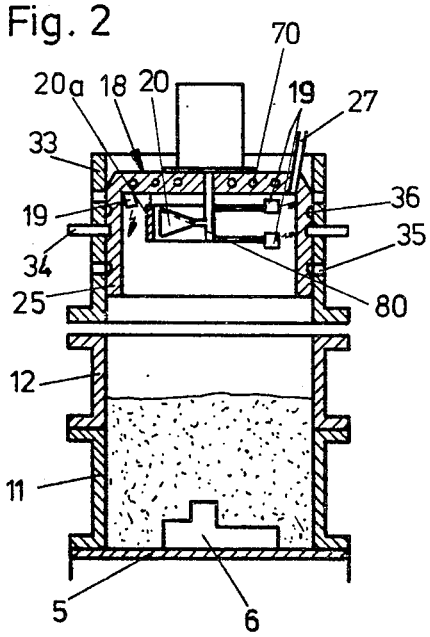
Figure 3:
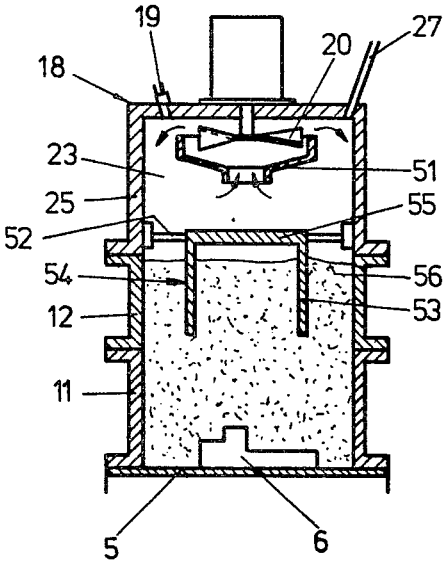
Figure 4:
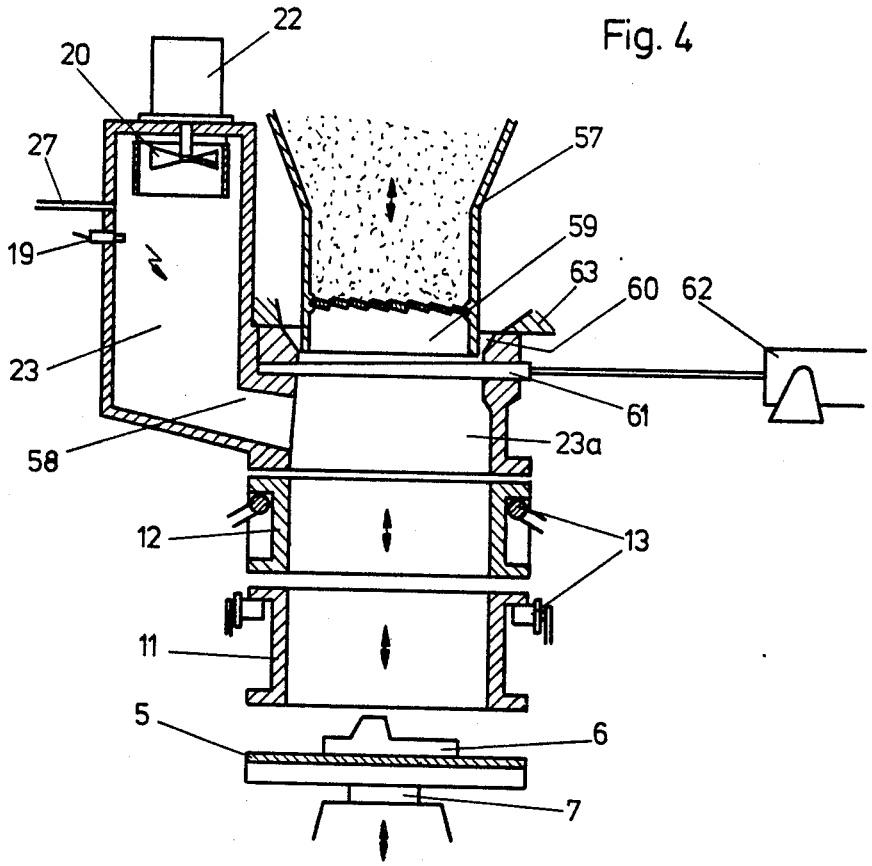
Figure 5:
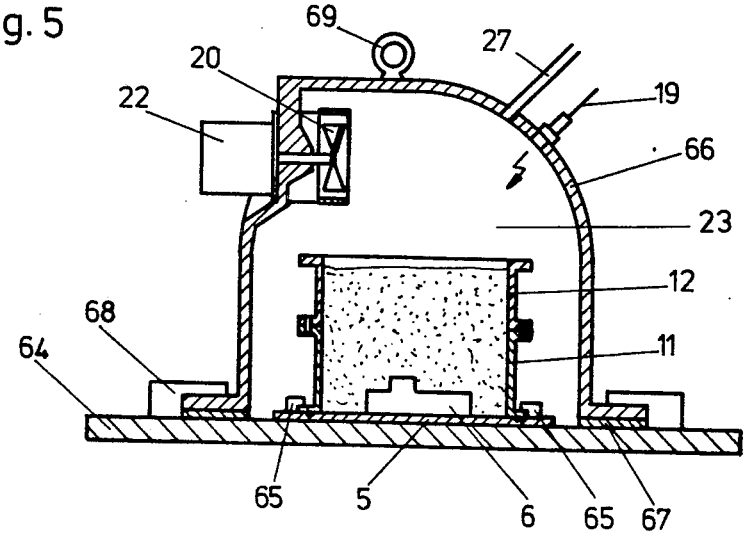

They show:

FIG. 1 moulding equipment with a first embodiment of a device according to the invention, FIG. 2 a second embodiment, FIG. 3 a third embodiment, FIG. 4 a fourth embodiment and FIG. 5 a fifth embodiment.

FIG. 1 shows moulding equipment in which one pattern plate 5 with pattern 6 comes after the other into the filling- and moulding station. Here the plate 5 is raised by means of a hydraulic lifting ram 7 via a moulding frame 11 and a filling frame 12, which are movable by means of rollers 13, against a sand container 17 containing a measured amount of moulding sand. After the sand has been poured into the moulding- and filling frames, the container 17 is horizontally shifted or swerved and a cap or hood 18 takes the place of the container 17. The cap 18, which more or less forms the combustion chamber 23 and which consists of an upper cover plate 24 and a side wall 25, has an initial pulse trigger, e.g. an igniter or spark plug 19, a blower 20 with guide ring **20*a* driven by an electric motor 22 and an inlet aperture 21 for fuel. An amount of fuel guaranteeing ignitability is conveyed through a line 27 into the combustion chamber 23 filled with air at atmospheric pressure, whereby the pressure rises minimally (with natural gas in the stoichiometric ratio e.g. the pressure rises by about 0.1 bar). The blower 20 mixes air and fuel to form an explosive mixture. In order to be able to control the movement of the explosive mixture, the blower 20 is advantageously power-variable by means of blade adjustment or change in speed. The igniter 19 ignites the mixture when the blower 20** is operating, e.g. by an electrical spark, and the moulding sand is packed. The maximum pressure increase is about 8 bar.

The drop in pressure depends, amongst other things, on the temperature of the wall which can be provided with cooling pipes 70 during continuous operation (automatic equipment) (see FIG. 2). In addition the exhaust gas escapes e.g. through grouped vents and/or between the parts 5, 11, 12 and 25. The excess pressure is reduced to zero when the ram 7 is lowered. The container 17 now comes into the filling position above the filling frame 12 and at the same time the cap 18 comes into position 28 drawn in dotted line, in which position an exhaust 29 removes the exhaust gases. Advantageously the blower 20 can remain constantly in operation in order to carry out three functions: mixing the combustion components, increasing the propagation speed of the combustion front during combustion and expelling the exhaust gases.

The smaller the combustion chamber, the less fuel or combustible gas is used and the more cheaply can the device be produced.

FIG. 2 shows a cap 18 which can slide in a frame 33 which fits on the filling frame 12, and which can be fixed in specific positions e.g. by means of pins 34 which pass through apertures 35 in the frame 33 and engage in the side wall 25. On the outer side of the wall 25 seals 36 are advantageously provided. This embodiment allows the optimum ratio of combustion chamber/sand filling volume to be adjusted respectively with different sized patterns. The adjustement of the cap 18 can also be effected by other means—in a hydraulic or pneumatic manner, or electrically with the aid of a servo-motor.

FIG. 3 shows two different matters which may be combined. First of all the preferred arrangement of the blower 20 is shown. Accordingly its suction nozzle 51 lies approximately coaxially over the sand or the pattern plate 5 so that the current, which the pressure wave follows, runs downwards against the side wall. Thus the resistance of sand/wall can be compensated, at least partially, with the aim of obtaining even more uniform hardness values at the interface.

Secondly another possibility is shown of affecting the mould strength along the interface. For this purpose a container 54, open at the bottom, is detachably connected to the wall 25 of the cap 18 by means of rods 52. After the filling process, the upstanding wall 53 of the container 54 dips into the sand, when the cap 18 is pressed against the moulding- and filling frames 11, 12, in such a way, that the surface 55, the closed side of the container 54, lies above the sand filling level 56. It has surprisingly been found that through this the compressive strength in the middle zone of the interface is reduced and in the wall zones it is somewhat increased.

With fairly large moulding- and filling frames 11, 12, several blowers 20 can be arranged in the combustion chamber 23 whereby also other devices producing a movement of the mixture, like e.g. mixing valves, devices producing a wave movement of the mixture etc. can be used.

It is also possible, instead of a blower 20, to arrange one or several initial pulse triggers constructed as igniters 19 in the combustion chamber 23 on a rotating shaft 80 (see FIG. 2, right-hand side), in which ignition time and rotation speed are preferably adjustable and hence an efficiently operating combustion process is obtained.

As a further variant, the arrangement of several igniters 19 arranged to be distributed on the cap 18 around the circumference and over the height, is possible, these igniters being ignited simultaneously or according to a predetermined time schedule.

FIG. 4 shows an embodiment with which a combustion chamber 23 is arranged laterally of a moulding material container 57, and this chamber is connected via an aperture 58 to a lower combustion chamber part 23*a*. A blower 20, driven by a motor 22, is connected to the cover of the combustion chamber 23. The supply line 27 for a fuel and the one or more than one igniter 19 is in a side wall of the combustion chamber 23.

The axis of symmetry of the lower combustion chamber part 23*a* is the same as that of the moulding material container 57 which with its outlet aperture 59 can be inserted into the filling aperture 60 of the combustion chamber part 23*a*. A slide plate 61 is provided as a closure means for the filling aperture 60, and this plate can be moved transversely with respect to the filling aperture 60 by means of a thrust piston drive 62. The filling frame 12 and the moulding frame 11 are arranged with the same axis of symmetry as the moulding material container 57 and can be lowered on rollers 13. As already described, the pattern plate 5 with pattern 6 are mounted on the plate of the lifting ram 7.

For the process of filling with moulding material the slide plate 61 is shifted into the open position and so the filling aperture is released. Next, by actuating the lifting ram 7 the filling frame 12 is raised until in joining relationship with the combustion chamber part 23*a*. Now the closure of the moulding material container 57 is opened and a measured or dosed amount of moulding material is fed in. Then the filling aperture 60 is closed by means of the slide plate 61 and the lifting ram 7 is raised to the "Pressing" position. With this process the combustion chamber part 23*a* is pressed against a frame 63 and hence the slide plate 61 is sealedly connected in position to the combustion chamber part 23*a*. Now the packing process can take place as already described.

FIG. 5 shows another embodiment in which a moulding frame 11, a filling frame 12 and a pattern plate 5 with pattern 6 sealedly connected to these frames by means of clamps 65 are disposed on a support 64. A cap, cover or housing 66 covering the moulding frame 11, the filling frame 12 and the pattern plate 5 is placed over a seal 67 onto the support 64 and is connected to the latter by means of clamps 68. The blower 20 with motor 22 are mounted to one part of the wall of the cap 66, and the fuel line 27 and the igniter 19 in the other part. A carrier ring 69 is provided for raising and lowering the cap 66.

By the use of one or more catalysts the combustion process with certain fuels can be accelerated and at the same time by a choice of catalysts a desired reproducible combustion process can be achieved.

These catalysts can be of precious metals like e.g. platinum, gold etc. and can be arranged in the combustion chamber 23 or can be introduced into the combustion chamber as additives with the fuel.

We claim:

1. In a process for packing granular materials wherein the granular materials are placed in a closed system and a mixture of air and fuel are ignited to cause the air and fuel to exothermically react and the pressure generated from the reaction compacts said granular materials, the improvement which comprises constantly moving the component with a blower just prior to the initiation of the exothermic reaction.

2. The process of claim 1 wherein the ignition is effected by at least one ignition pulse.

3. The process according to claim 1 or 2 wherein a solid fuel is used.

4. The process according to claim 1 or 2 wherein a liquid fuel is used.

5. The process according to claim 1 or 2 wherein gaseous fuel is used.

6. The process of claim 5 wherein the fuel is a saturated hydrocarbon or mixture thereof.

7. The process according to claim 1 or 2 wherein the maximum pressure in the closed system, reached after initiation of combustion, is under 8 bar.

8. The process according to claim 1 or 2 wherein the surface of the granular material to be packed is covered, completely or partially with a gas-impermeable cover before initiation of the exothermic reaction.

9. The process according to claim 1 or 2 wherein the exothermic reaction is accelerated by means of a catalytic effect.

10. A device for packing granular materials wherein the granular materials are placed in a closed system and a mixture of air and fuel are ignited to cause the air and fuel to exothermically react and the pressure generated from the reaction compacts said granular materials comprising a pattern plate (5) for receiving the granular material to be packed with a moulding-frame (11) and a filling frame (12) disposed thereon and with a cap-shaped combustion chamber (23) connected to it, this chamber having at least one inlet aperture (21) and at least one initial ignition pulse trigger (19), and means (20, 80) for producing a relative movement between the combustible mixture and the initial pulse triggers (19), said means being a blower.

11. A device for packing granular materials wherein the granular materials are placed in a closed system and a mixture of air and fuel are ignited to cause the air and fuel to exothermically react and the pressure generated from the reaction compacts said granular materials comprising a pattern plate (5) for receiving the granular material to be packed with a moulding-frame (11) and a filling frame (12) disposed thereon and with a cap-shaped combustion chamber (23) connected to it, this chamber having at least one inlet aperture (21) and at least one initial ignition pulse trigger (19), and means (20, 80) for producing a relative movement between the combustible mixture and the initial pulse triggers (19), said means being a movable ignition pulse trigger.

12. The device of claim 10 wherein the blower is power variable.

13. The device of claim 10 or 11 wherein the volume of the combustion chamber (23) is variable.

14. The device of claim 10 or 11 having a container (54) open at the bottom and connectible with the wall (25) of the combustion chamber (23), the open side of the container lying below the granular material filling level (56) and the closed side (55), opposite the open side, lying above the granular material filling level (56).

* * * * *